US006791070B2

(12) United States Patent
Kim

(10) Patent No.: US 6,791,070 B2
(45) Date of Patent: Sep. 14, 2004

(54) SIMMERING CONTROL METHOD IN MICROWAVE OVEN

(75) Inventor: Kwang Hwa Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/630,784

(22) Filed: Jul. 31, 2003

(65) Prior Publication Data

US 2004/0094539 A1 May 20, 2004

(30) Foreign Application Priority Data

Nov. 14, 2002 (KR) ..... 10-2002-0070916

(51) Int. Cl.[7] ..... H05B 6/68

(52) U.S. Cl. ..... 219/707; 219/719; 219/716; 99/325; 426/243

(58) Field of Search ..... 219/703, 707, 219/702, 704, 705, 719, 720, 715, 716, 492; 99/325, DIG. 14; 426/241, 243, 523

(56) References Cited

U.S. PATENT DOCUMENTS 4,335,293 A * 6/1982 Kobayashi et al. ..... 219/707
4,336,433 A * 6/1982 Yokozeki ..... 219/707
RE31,094 E * 11/1982 Kobayashi et al. ..... 219/707
4,791,263 A * 12/1988 Groeschel, Jr. ..... 219/707
5,545,881 A * 8/1996 Chai et al. ..... 219/719

* cited by examiner

*Primary Examiner*—Philip H. Leung
(74) *Attorney, Agent, or Firm*—McKenna Long & Aldridge LLP

(57) ABSTRACT

A method of performing a simmer cooking operation in a microwave oven is based on detected levels of humidity from a sensor and an algorithm automatically calculating a cooking time such that a desired cooking operation is optimally performed. A third heating operation is performed at about 30% of the maximum power level of the microwave oven. The third heating operation is performed for an amount of time equal to a sum of an amount of time during which first and second heating operations are performed adjusted by a predetermined constant. The total heating time is calculated and controlled by adding the amount of time during which the third heating operation is performed to the time during which the first and second heating operations are performed.

20 Claims, 5 Drawing Sheets

SIMMERING CONTROL METHOD IN MICROWAVE OVEN

This application claims the benefit of Korean Patent Application No. P2002-70916, filed on Nov. 14, 2002, which is hereby incorporated by reference for all purposes as if fully set forth herein.

BACKGROUND OF THE INVENTION

1. Field of the Invention

The present invention relates to a microwave oven. More particularly, the present invention relates to a method of automatically controlling a cooking operation such as a simmer or thawing operation in a microwave oven wherein, during cooking, food products containing moisture (either in a liquid or frozen form) such as broth, or the like, may be heated at a strong power and then slowly heated with a weak power, and wherein the automatically controlled cooking operation can be automatically performed regardless of the amount or type of food being cooked.

2. Description of the Related Art

Generally, microwave ovens automatically control the degree to which food is heated using sensors capable of detecting physical quantities that evolve as the food is heated. In particular, gas or humidity sensors, capable of detecting vapor generated when food is heated, are generally used by microwave ovens having automatic cooking features. Such related art sensors will now be explained in greater detail.

Generally, humidity sensors operate by measuring the increased voltage passing through an element when moisture, created within the microwave oven heating food and absorbed by the humidity sensor, decreases the electrical resistance of the element. Microwave ovens incorporating an automatic cooking feature using such humidity sensors are disclosed in, for example, U.S. Pat. Nos. 4,335,293, 4,336,433, and Re. 31,094. In view of the aforementioned patents, it can be understood that food is heated within microwave oven for an initial time period T1, measured from a starting point of the heating to a second point of time when humidity generated by the heated food changes abruptly, and for an additional time period AT1, wherein A is a constant specific to the type of the food being heated. Accordingly, the total time period during which the food is heated is T1+AT1.

A method and apparatus for simmering food in a microwave oven has been disclosed in U.S. Pat. No. 4,791,263 (herein referred to as the '263 patent).

FIG. 3 illustrates the consecutive output power levels applied over time in the microwave oven simmering method disclosed in the '263 patent. FIG. 4 illustrates an operating process flowchart for controlling the simmering operation of the '263 patent.

Referring to FIGS. 3 and 4, a process for performing a simmer cooking operation in a microwave oven using a related art humidity sensor will now be explained.

First, a simmer key is pressed by a user to initiate a simmer cooking operation of a microwave oven. Next, a microwave cooking chamber (i.e. cooking chamber) is purged by ventilating the cooking chamber for a predetermined time period (e.g., 15 seconds) so that oven sensors can be stabilized (steps 101 and 102). During steps 101 and 102, signals generated by the humidity sensor cannot be used to control heating.

After the predetermined time period has elapsed, the microwave oven performs the simmer cooking operation using the humidity sensor. Accordingly, after the predetermined time period has elapsed, an initial level of the humidity within the cooking chamber, detected by the humidity sensor, is inputted into memory (step 103). Next, heating commences at 70% of a maximum power level provided by the microwave oven (step 104).

As heating progresses, the humidity sensor generates signals based on the detected humidity levels within the oven chamber. The generated signals are continuously read and compared with the initial level inputted into the memory. Accordingly, a difference in humidity value between the initial and detected humidity levels is calculated (step 105). Next, a determination is made as to whether the calculated difference of values has reached a predetermined difference value (step 106). The initial heating time T1 is counted until a difference value reaches the predetermined value according to a determination result in step 106. By setting T1 according to the time period required to reach the predetermined difference value in initial and detected humidity levels, steps 103 to 106 determine the time period required to generate a predetermined level of humidity after the simmer cooking operation of a microwave oven has been initiated. The value of T1 will generally be larger when a large amount of food is heated as compared to when a relatively smaller amount of the food is heated.

After it has been determined in step 106 that the calculated difference in humidity values reaches the predetermined difference value, the initial time period T1 becomes fixed and the food is heated for a second time period T2, calculated on the basis of the initial heating time T1 (step 107). The second time period T2 is determined by multiplying the initial time period T1 by a predetermined constant value B, different from the aforementioned predetermined constant value A. During the second time period T2, the food is heated at 50% of the maximum power level (step 108).

After the second time period T2 has elapsed, heating at 50% of the maximum power level is stopped (step 109). Subsequently, the food is heated for a third time period T3 at 30% of the maximum power level (step 110). A user must select a value to set the third time period. The third time period is set according to either the amount of food to be heated or according to a user's preference (step 111). More specifically, if a specific key is pressed, the third time period is 210 minutes (step 112). Otherwise, the third time period is 90 minutes (step 113).

After the third time period T3 has elapsed, the food is kept warm during a fourth time period T4 whereby the food is heated at 10% of the maximum power level (step 114). When initiated, the display unit indicates the 'keep-warm' operation is being performed. The 'keep-warm' operation is performed until the cooking is stopped. When the user stops heating the food, the simmer cooking operation is completed.

Referring to FIG. 3, the total amount of time required by the related art simmer cooking operation described above is divided into four stages. According to the related art, the heating power levels used during the four stages are set at predetermined power levels, the first and second amounts of time T1 and T2, respectively, are determined automatically according to the amount of food within the cooking chamber, and the third time period T3 is one of two values that must be selected by the user.

Use of the aforementioned related art simmer cooking operation is disadvantageous because the user is required to actively determine the value of the third time period T3. If the user does not select the third time period T3 (by pressing a select key), the food is always heated for an additional 90 minutes, regardless of the amount of food within the cooking chamber. Accordingly, the effectiveness of the simmer cooking feature may be deteriorated.

Furthermore, use of the aforementioned related art simmer cooking operation is disadvantageous because the power levels applied upon heating within the first and second time periods T1 and T2 are not at the maximum power but at 70% and 50% of the maximum power level of the microwave oven. By not using the maximum power levels of the microwave oven, the total amount of time required to effectively perform the simmer cooking operation becomes prohibitively excessive.

SUMMARY OF THE INVENTION

Accordingly, the present invention is directed to a simmering control method in a microwave oven that substantially obviates one or more of the problems due to limitations and disadvantages of the related art.

An advantage of the present invention provides a reduced cooking time compared to related art simmering control methods such as those described above.

Another advantage of the present invention improves the cooking quality of a microwave oven, wherein a user does not have to perform additional operations.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a method of controlling a cooking operation (e.g., simmer cooking, thawing, etc.) in a microwave oven may, for example, include performing a first beating operation in the microwave oven at a maximum power level for a first time period T1 when a value detected by a sensor reaches a predetermined value, performing a second heating operation at the maximum power for a second time period T2, wherein the second time period T2 corresponds to a value obtained by multiplying the first time period T1 by a first predetermined constant K, and performing a third heating operation at about 30% of the maximum power level for a third time period T3, wherein the third time period T3 corresponds to a value obtained by multiplying the sum of the first and second time period T1 and T2 by a second predetermined constant C.

In one aspect of the present invention, the sensor may comprise a humidity sensor.

In another aspect of the present invention, the first through third heating operations may be automatically performed upon initiation of the cooking operation supported by a microwave oven.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
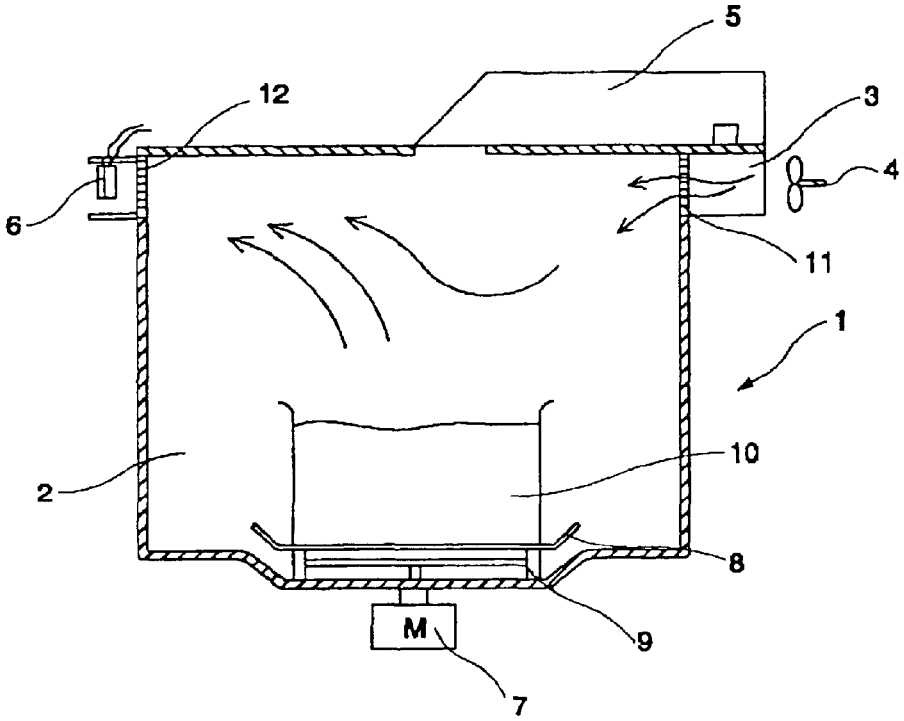
FIG. 1 illustrates a sectional view of a microwave oven having a sensor.

FIG. 1 illustrates a sectional view of a microwave oven having a humidity sensor for controlling cooking operations.

Referring to FIG. 1, a user may perform a cooking operation (e.g., simmer cooking, thawing, etc.) in a microwave oven 1, by opening a door (not shown) of the microwave oven 1 and arranging food 10 within a cooking chamber 2 and, optionally, on a turntable 8 arranged therein. The user may then select a key (not shown) corresponding to a cooking operation (e.g., simmer cooking, thawing, etc.), close the door of the cooking chamber 2, and press a start button, initiating the cooking operation. Accordingly, when the start button is pressed, electromagnetic waves may be generated from a magnetron 3 and transmitted to the food 10 through a waveguide 5 to heat the food within the cooking chamber 2. According to the principles of the present invention, the food may become heated due to friction created between moving molecules of food, induced by the electromagnetic waves. Although not shown in the Figure, a control panel unit may be arranged at one side of the exterior of the microwave oven and electric components for controlling various cooking operations of the microwave over may also be provided.

As the food 10 is heated during the cooking operation, moisture within the food 10 evaporates and a vapor is generated within the cooking chamber 2. A fan 4, provided for cooling the electric components in the microwave oven, may generate an air flow and discharge the vapor in the cooking chamber 2 outside of the microwave oven 1 via air exhaust port 12. A humidity sensor 6 may be arranged proximate the air exhaust port 12 to detect a humidity level within the discharged air flow, due to the presence of the vapor in the air flow. Based upon the detected humidity level, the cooking operation (e.g., simmer cooking, thawing, etc.) of the present invention may be controlled as will be described in greater detail below.

Figure 2:
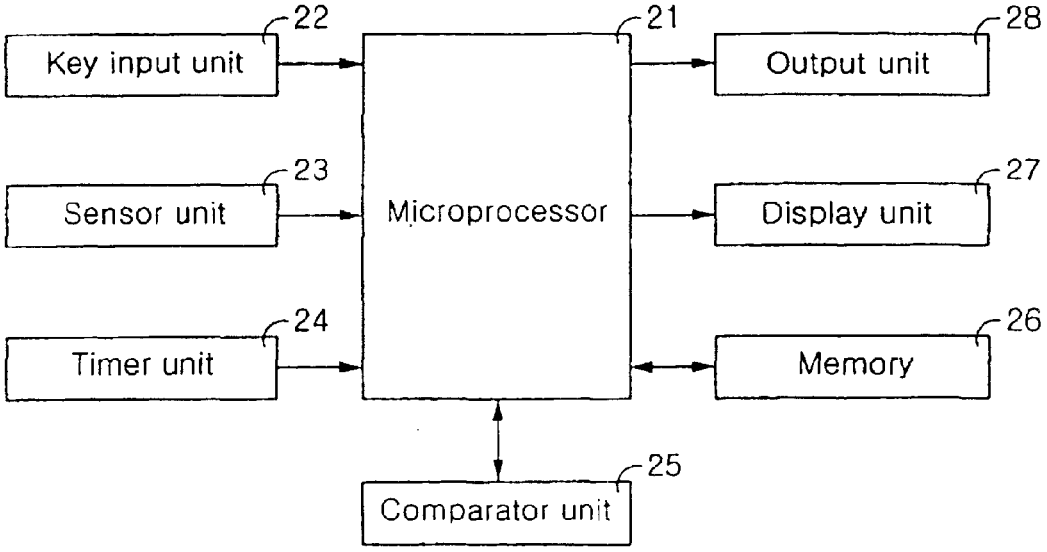
FIG. 2 schematically illustrates a control configuration of the microwave oven shown in FIG. 1.
Figure 3:
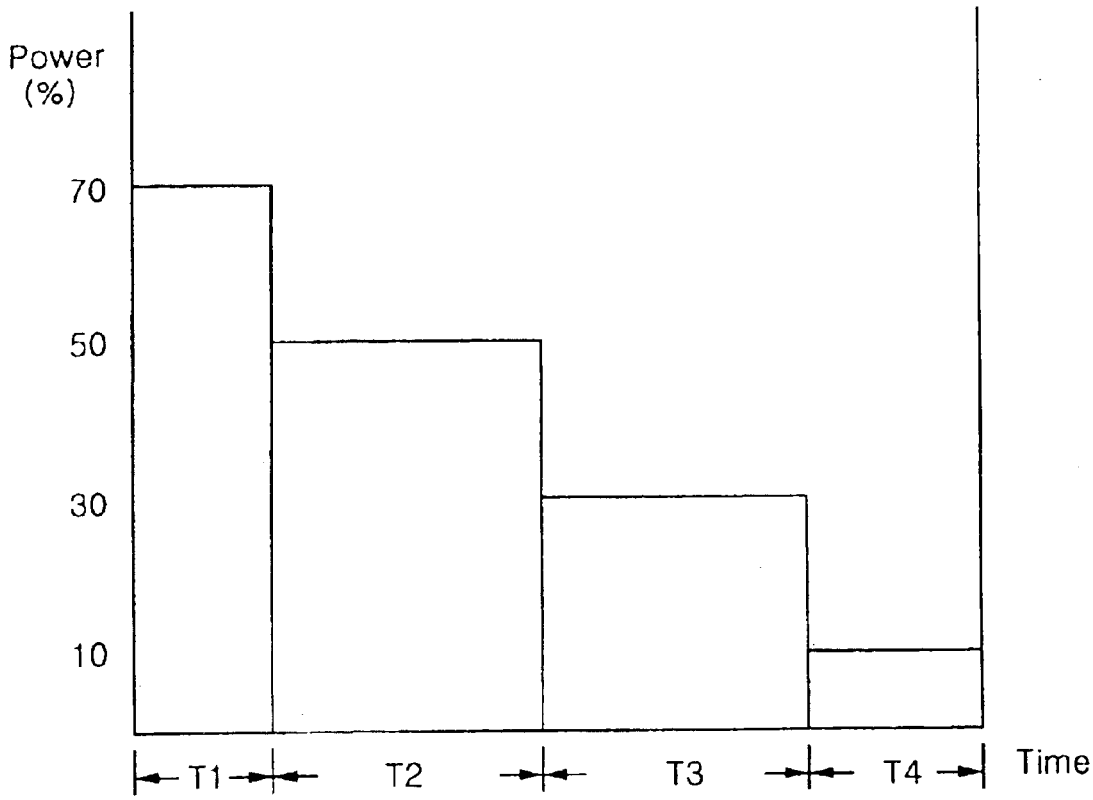
FIG 3. RELATED ART
FIG. 3 illustrates output power levels of a related art microwave oven applied over time in a related art microwave oven simmer cooking operation.
Figure 4:
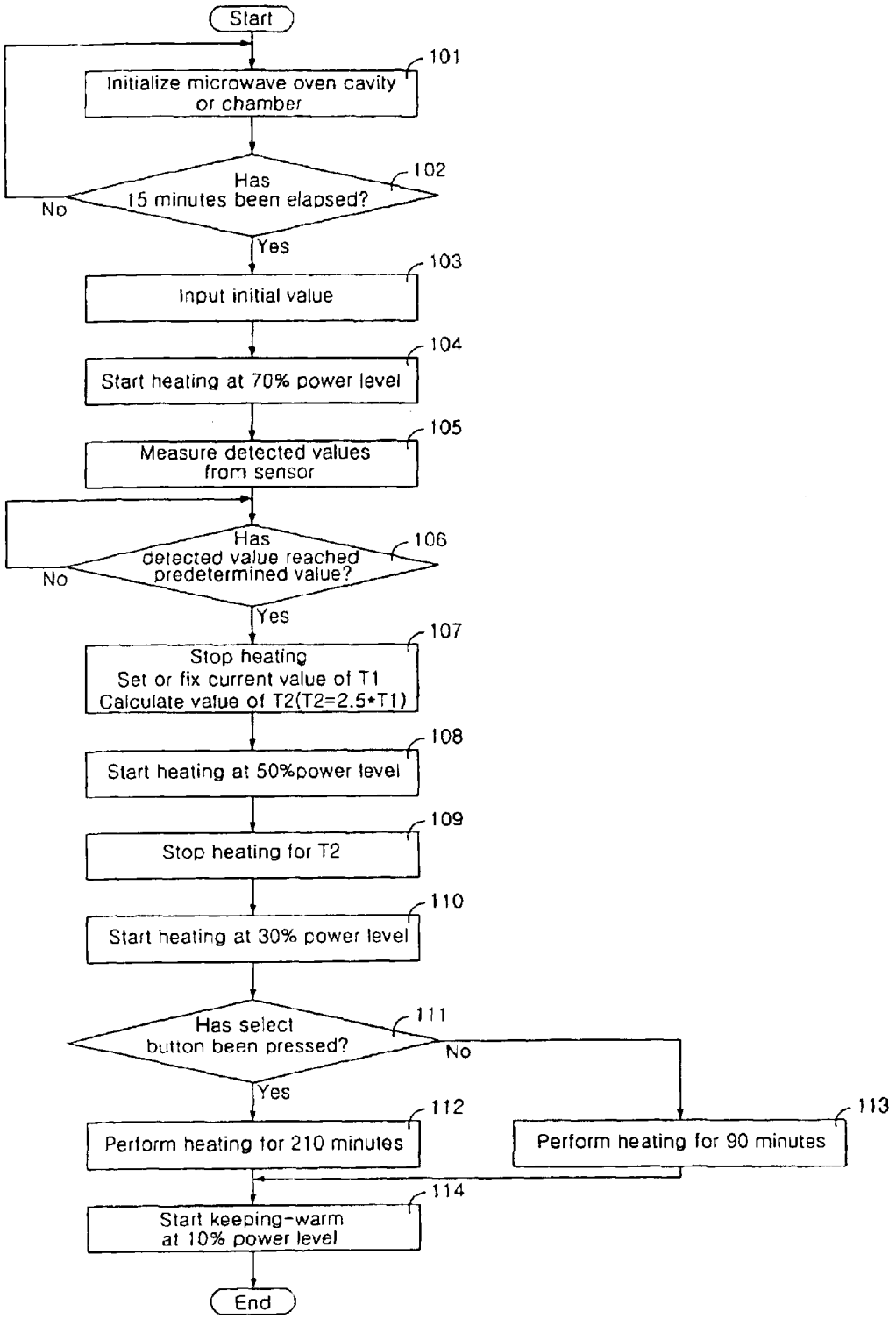
FIG 4. RELATED ART
FIG. 4 illustrates a process flowchart used in controlling the simmer cooking operation in a related art microwave oven.

FIG. 2 schematically illustrates a control configuration of the microwave oven shown in FIG. 1.

Referring to FIG. 2, the control panel unit may include a key input unit 22 for selecting a cooking menu from preprogrammed cooking menus provided at the control panel unit. The key input unit 22 and a sensor unit 23 (e.g., humidity sensor 6) may be electrically connected to a microprocessor 21 such that signals inputted through the key input unit 22 and signals detected from the sensor unit 23 may be transmitted to the microprocessor 21 and stored within memory 26. In one aspect of the present invention, cooking algorithms, recipes, etc., predetermined based on microwave oven, may also be stored in the memory 26. In another aspect of the present invention, a cooking algorithm (e.g., simmer cooking, thawing, etc.) may include a determination algorithm for determining heating time, power levels of respective stages, and the like, when a simmer cooking operation is initiated within the microwave oven 1.

Still referring to FIG. 2, a comparator unit 25 may be provided for comparing a voltage signal having a value indicative of an instant humidity level, provided by the sensor unit 23 (e.g., humidity sensor 6) with a voltage signal having a value indicative of a preceding humidity level stored in the memory 26. The comparator unit 25 may also determine a difference between voltage signals having values indicative of the instant and preceding humidity levels.

Still referring to FIG. 2, a timer unit 24 may be provided for determining whether time periods required by a cooking operation have elapsed. The memory 26, the comparator unit 25, and the timer unit 24 may be connected to the microprocessor 21 such that they may receive and transmit signals to and from the microprocessor 21.

An output unit 28 may be provided for generating power at levels capable of performing a cooking operation. In one aspect of the present invention, the microprocessor 21 may be used to adjust the power level generated by the output unit 28. In another aspect of the present invention, the output unit 28 may be provided as the magnetron 3, serving as the source of the electromagnetic waves.

Finally, and while referring to FIG. 2, a display unit 27 may be provided for indicating an amount of cooking time remaining after a cooking operation has been initiated. In one aspect of the present invention, the display unit 27 may communicate predetermined cooking information to the user. For example, at the predetermined time, the display unit 27 may communicate information indicating a cooking operation has been completed.

A cooking operation (e.g., simmer, thawing, etc.) according to the principles of the present invention will be explained below with reference to FIGS. 5 and 6.

Figure 5:
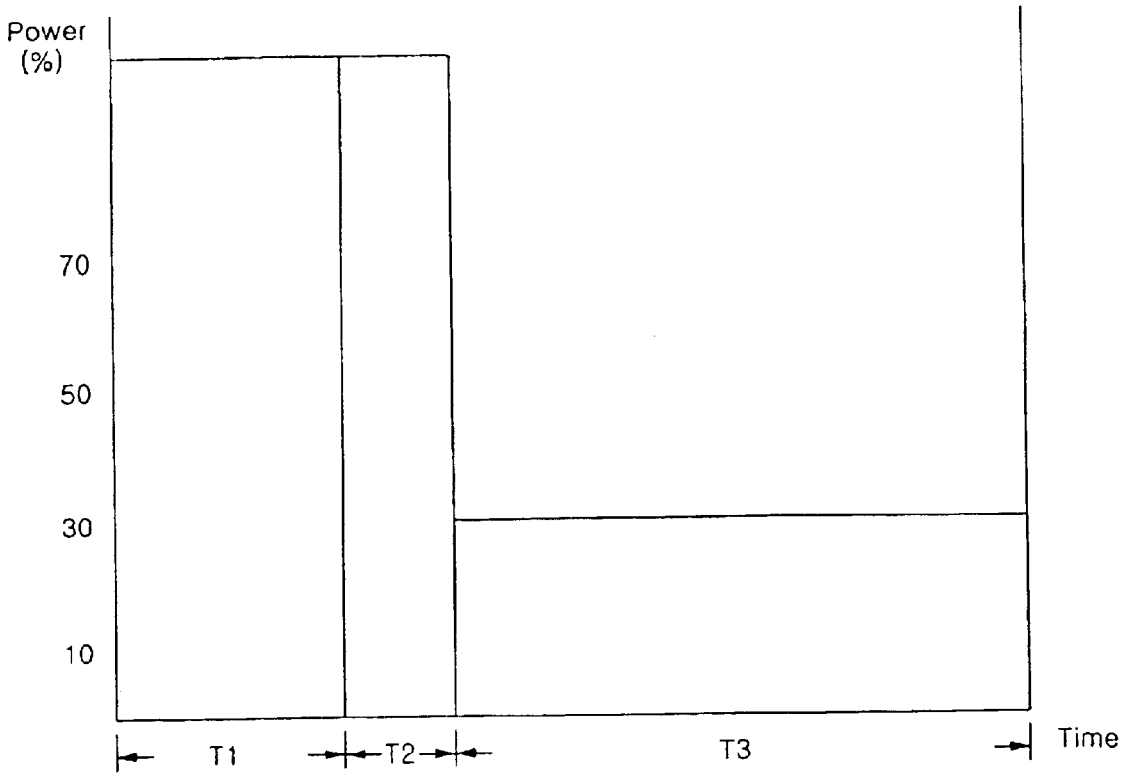
FIG. 5 illustrates the output power levels of the microwave oven applied over time in the cooking operation of the present invention.

FIG. 5 illustrates the output power levels of the microwave oven applied over time in the cooking operation of the present invention. FIG. 6 illustrates a process flowchart used in controlling the cooking operation of the present invention.

Figure 6:
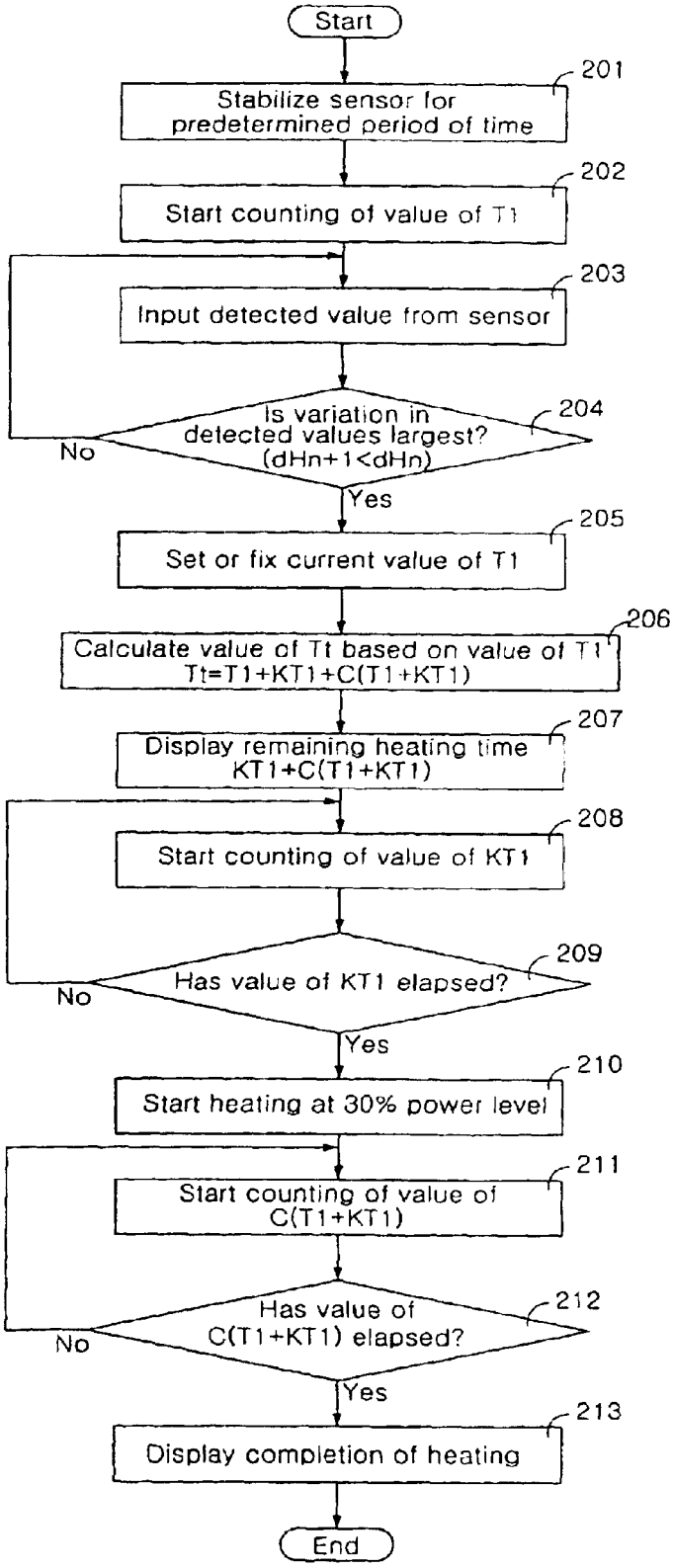
FIG. 6 illustrates an process flowchart used in controlling the cooking operation of the present invention.

Referring to FIG. 6, the humidity sensor 6 may first be stabilized (step 201) by ventilating the cooking chamber for a predetermined amount of time. Stabilizing the humidity sensor 6 may prevent the moisture or existing humidity levels in the cooking chamber from deleteriously affecting control of the simmer cooking operation. During step 201, voltage signals generated by the humidity sensor 6 are not used to control the cooking functions of the microwave oven 1.

After the predetermined time period has elapsed, a first heating operation begins and the microprocessor 21 and timer unit 24 may start counting (step 202) the amount of time required to complete the first heating operation (i.e., the first time period T1). As shown in FIG. 5, food is heated at substantially a maximum power level of the microwave oven for substantially the duration of the first time period T1.

Next, the humidity sensor 6 begins generating voltage signals having values indicative of instantaneous humidity levels within the cooking chamber (step 203). In one aspect of the present invention, the voltage signals may be continuously inputted to microprocessor 21 and stored in memory 26.

Next, in step 204, the comparator unit 25 may be used to determine whether a change between an instant humidity level measurement and a preceding humidity level measurement is at its greatest. For example, the comparator 25 may determine a difference in value between consecutively generated voltage signals from the sensor unit 23 (e.g., the humidity sensor 6), indicative of evolving humidity levels within the microwave oven. Further, the comparator 25 may compare consecutive ones of the determined differences of voltage signal values to determine at what time, after humidity levels within the cooking chamber 2 increase, the humidity level within the cooking chamber 2 decreases. Accordingly, the point in time when the humidity level is maximized within the cooking chamber 2 may be determined. Moreover, the microprocessor 21 may determine the degree to which the food is cooked based on the values of the voltage signals generated by the sensor unit 23 (e.g., humidity sensor 6).

Accordingly, in step 204, if it is determined that difference in humidity levels are not decreasing after the sinner cooking operation has started, the first time period T1 continues to be counted. If, however, it is determined that difference in humidity levels are decreasing after the cooking operation (e.g., simmer, thawing, etc.) has started, the first time period T1 is determined and set to the time when the difference in humidity levels have decreased (step 205).

Next, a total amount of time Tt required to perform the cooking operation is determined in accordance with the first time period T1 (step 206). In one aspect of the present invention, the total heating time Tt may be determined by adding the first time period T1 to a second time period T2 and a third time period T3. In one aspect of the present invention, the second time period T2 may be obtained by multiplying the first heating time T1 by a first predetermined constant, K, that is specific to the type of food being cooked or the type of cooking operation being performed (e.g., simmer, thawing, etc.). Accordingly, the second time period T2 is equal to KT1. In another aspect of the present invention, the third time period T3 may be obtained by multiplying the sum of the first heating time T1 and the second time period T2 by a second predetermined constant, C. Accordingly, the third time period T3 is equal to C(T1+KT1) and the total heating time Tt=T1+KT1+C(T1+KT1). According to the principles of the present invention, the first time period T1 will generally be larger when a large amount of food is heated as compared to when a relatively smaller amount of the food is heated. Thus, as the first time period T1 increases, the second and third time periods T2 and T3, respectively, may also increase.

According to the principles of the present invention, the total heating time Tt may be determined in accordance with the first time period T1, which may be determined according to the amount of food, and the first predetermined constant K, which may be determined according to the type of food being cooked and/or the type of cooking operation being performed (e.g., simmer cooking, thawing, etc.).

As mentioned above, the first predetermined constant K may be determined based according to the type of food being cooked. However, increasing the types of food that may be represented by the first predetermined constant K, for the purposes of accurately determining a suitable total heating time Tt, deleteriously increases the size of memory 26 along with the time required to program the microwave oven. Accordingly, the number values the first predetermined constant K may have may be limited to two or three depending on the type of cooking operations being performed. In one aspect of the present invention, the first predetermined constant K may have a singular value of about 0.2.

According to the principles of the present invention, a one-to-one correspondence may exist between the number of first and second predetermined constants K and C, respectively, to facilitate programming and handle memory requirements. According to the principles of the present invention, the second predetermined constant C may have singular value of about 2.5. In one aspect of the present invention, the microwave oven may be provided with an adjustment key allowing a user to increase or decrease the third time period T3 within a range of approximately ±30%. Accordingly, the adjustment key may be allow a user to vary the value of the second predetermined constant C between about 1.7 and about 3.3.

According to the principles of the present invention, a user can perform a desired cooking operation (e.g., simmer, thawing, etc.), irrespective of the type or amount of food to be cooked, even though a single value for the second predetermined constant C is used at any time.

After the total heating time Tt has been calculated in step 206, the time remaining within the second and third time periods T2 and T3, during which the simmer cooking operation is to be completed, may be displayed on the display unit 27. Accordingly, the display unit 27 may allow a user to realize the amount of time require to complete the simmer cooking operation. Further, the remaining time may be continuously counted and displayed (step 207).

After displaying a remaining amount of time (step 207), and after the first time period T1 has elapsed, the microprocessor 21 and the timer unit 24 may start counting the amount of time (i.e., the second time period T2) required to complete a second heating operation (step 208). As shown in FIG. 5, food is heated at the maximum power level of the microwave oven for the duration of the second time period T2. Accordingly, food is heated at substantially the maximum power level of the microwave oven for substantially the duration of the first and second time periods T1 and T2.

Referring back to FIG. 6, it is determined whether the second time period T2 has elapsed (step 209). If the second time period T2 has elapsed, the heating power of the microwave oven is reduced from the maximum power level to a lower power level (step 210), and the microprocessor 21 and the timer unit 24 may start counting the amount of time (i.e., the second time period T3) required to complete a third heating operation (step 211). In one aspect of the present invention, the lower power level output during the third heating operation may be about 30% of the maximum power level used during the first and second heating operations. According to the principles of the present invention, the third time period T3 is counted and the remaining time may be continuously displayed on the display unit 27 (step 211).

Next, it is determined whether the third time period T3 has elapsed (step 212). If the third time period T3 has elapsed, a message indicating that the third heating operation, and thus the cooking operation has been completed, may be displayed (step 213).

According to the principles of the present invention, the method and apparatus for performing a cooking operation (e.g., simmer, thawing, etc.) is advantageous because the amount of time required to perform the simmer cooking operation can be automatically determined according to the amount and/or type of food to be cooked without any additional actions required by the user to manually select additional heating times. Moreover, the first and second heating operations, accomplishing the bulk of the boiling or cooking, may be performed during first and second time periods T1 and T2, while only the third heating operation is performed at a reduced power output level, thereby minimizing the total heating time Tt required to perform a cooking operation. Further, variations in simmer cooking effectiveness resulting from the manual selection of additional heating times is eliminated and cooking quality may be made consistent and optimal.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A cooking operation in a microwave oven, comprising:

providing a microwave oven having a sensor for detecting humidity levels within the microwave oven;

performing a first heating operation at a maximum power level of the microwave oven for a first time period;

determining whether the sensor detects a predetermined level of the condition, wherein the first time period is terminated when the predetermined level is detected by the sensor;

performing a second heating operation at the maximum power level for a second period of time, wherein the second period of time is determined by multiplying the first time period by a first predetermined constant; and performing a third heating operation at a power level lower than the maximum power level for a third period of time, wherein the third period of time is determined by multiplying the sum of the first and second time periods by a second predetermined constant.

2. The method as claimed in claim 1, wherein the sensor outputs electrical signals indicative of the level of humidity within the chamber.

3. The method as claimed in claim 1, wherein the predetermined level of the condition includes a maximum variation in detected conditions from the sensor.

4. The method as claimed in claim 1, further comprising determining the first predetermined constant in accordance with a type of food to be heated within the microwave oven.

5. The method as claimed in claim 1, further comprising determining the first predetermined constant in accordance with a type of cooking operation being performed.

6. The method as claimed in claim 5, wherein the type of cooking operation being performed is a simmer cooking operation.

7. The method as claimed in claim 5, wherein the type of cooking operation being performed is a thawing operation.

8. The method as claimed in claim 1, wherein a number values assignable to the second predetermined constant equals a number of values assignable to the first predetermined constant.

9. The method as claimed in claim 1, wherein an initial value of the second predetermined constant is selectively variable within a range of about 30%.

10. The method as claimed in claim 1, wherein the third heating operation is performed at about 30% the maximum power level.

11. A method of controlling a simmer cooking operation in a microwave oven, comprising:

determining an amount of time to correspond to a first time period when a first beating operation is completed based on when a detected level from a sensor reaches a predetermined value;

determining a total heating time based on the first time period;

continuously displaying an amount of time remaining within the total heating time;

determining whether a second time period when a second heating operation performed at a maximum power level of the microwave oven has elapsed, wherein the amount of time remaining within the total heating time comprises the second time period;

performing a third heating operation at power level lower than the maximum power level for a third time period, wherein the third time period corresponds to a sum of the first time period and the second time period multiplied by a first predetermined constant; and determining whether the total heating time has elapsed, wherein a termination of the total heating time substantially coincides with a termination of the third time period.

12. The method as claimed in claim 11, wherein the sensor detects humidity levels in a chamber of the microwave oven and outputs electrical signals having values indicative of the detected levels of humidity.

13. The method as claimed in claim 11, wherein the predetermined value comprises a maximum variation in detected value from the sensor.

14. The method as claimed in claim 11, further comprising determining a length of the second time period using a second predetermined constant, wherein the second predetermined constant is variable in accordance with a type of food to be heated within the microwave oven.

15. The method as claimed in claim 11, further comprising determining a length of the second time period using a second predetermined constant, wherein the second predetermined constant is variable in accordance with a type of cooking operation to be performed within the microwave oven.

16. The method as claimed in claim 15, wherein the type of cooking operation includes a simmer cooking operation.

17. The method as claimed in claim 15, wherein the type of cooking operation includes a thawing operation.

18. The method as claimed in claim 14, wherein a number of values assignable to the first predetermined constant equals a number of values assignable to the second predetermined constant.

19. The method as claimed in claim 11, wherein an initial value of the first predetermined constant is selectively variable within a range of about 30%.

20. The method as claimed in claim 11, wherein the third heating operation is performed at about 30% the maximum power level.

* * * * *